US006502438B1

(12) United States Patent
Miller et al.

(10) Patent No.: US 6,502,438 B1
(45) **Date of Patent: *Jan. 7, 2003**

(54) ELECTRONIC COMBINATION LOCK HAVING ANTI-TAMPERING FEATURES

(75) Inventors: J. Clayton Miller, Nicholasville, KY (US); Michael P. Harvey, Laguna Niguel, CA (US)

(73) Assignee: C&M Technology, Inc., Nicholasville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/492,409

(22) Filed: Jan. 27, 2000

Related U.S. Application Data

(63) Continuation-in-part of application No. 09/985,975, filed on Nov. 7, 2001, which is a continuation of application No. 09/409,760, filed on Sep. 30, 1999, now Pat. No. 6,314,773, which is a continuation of application No. 08/985,901, filed on Dec. 5, 1997, now Pat. No. 5,960,655, which is a continuation of application No. 08/593,725, filed on Jan. 29, 1996, now Pat. No. 5,720,194, which is a division of application No. 08/371,319, filed on Jan. 11, 1995, now Pat. No. 5,487,290, which is a continuation of application No. 07/819,216, filed on Jan. 13, 1992, now abandoned.

(51) Int. Cl.[7] ..... E05B 49/02

(52) U.S. Cl. ..... 70/303 A; 70/278.1; 70/278.7; 74/527; 292/142; 292/144

(58) Field of Search ..... 70/278.7, 283, 70/DIG. 54, 277, 276, 278.1, 278.4, 278.5, 278.6, 303 A; 292/142, 144, 201; 74/527

(56) References Cited

U.S. PATENT DOCUMENTS

| | | | | | |
|---|---|---|---|---|---|
| 686,073 | A | * | 11/1901 | Hollar et al. | 70/278.6 |
| 1,377,061 | A | * | 5/1921 | Deeg | 70/283 |
| 1,927,354 | A | * | 9/1933 | Walker | 70/283 |
| 2,028,852 | A | * | 1/1936 | Vincent | 70/283 |
| 2,399,906 | A | * | 5/1946 | Bentley | 74/527 |
| 3,468,143 | A | * | 9/1969 | Douglas et al. | |
| 3,733,861 | A | * | 5/1973 | Lester | 70/153 |
| 3,978,376 | A | * | 8/1976 | Wilson | 317/134 |

(List continued on next page.)

FOREIGN PATENT DOCUMENTS

| | | | | |
|---|---|---|---|---|
| DE | 950962 | * | 10/1956 | 70/283 |
| DE | 1065871 | * | 9/1959 | |
| DE | 3817696 | * | 11/1989 | |
| EP | 0260860 A1 | * | 3/1988 | |
| EP | 0361881 | * | 4/1990 | |
| FR | 1543004 | * | 10/1968 | |

OTHER PUBLICATIONS

X–07: A Safe Lock That Operates Electronically, 2342 Locksmith Ledger International, No. 9 (Jul. 1991).*

*Primary Examiner*—Lloyd A. Gall
(74) *Attorney, Agent, or Firm*—Wood, Herron & Evans, L.L.P.

(57) ABSTRACT

An electronic combination lock including an electronic combination input device, a lock-bolt mounted for movement between locked and unlocked positions and a rotatable first engagement element having disengaged and engageable positions. A first electric actuator is electrically coupled with the electronic combination input device and includes a rotatable output for rotating the first engagement element to its engageable position in response to a proper combination input. A manually operated and rotatable second engagement element may be engaged with the first engagement element in the engageable position thereof. A lock-bolt drive mechanism is operatively coupled between the lock-bolt and the first engagement element. A second electric actuator includes a movable output operatively coupled to the first engagement element to prevent the first engagement element from rotating until the proper combination is input.

16 Claims, 4 Drawing Sheets

U.S. PATENT DOCUMENTS 4,232,354 A * 11/1980 Mueller et al.
4,438,962 A * 3/1984 Soloviff et al. ..... 292/144
4,625,848 A * 12/1986 Meyers et al. ..... 292/142 X
4,671,087 A * 6/1987 Olenfalk et al. ..... 70/283
4,712,398 A * 12/1987 Clarkson et al. ..... 70/283 X
4,745,784 A * 5/1988 Gartner ..... 70/277
4,754,625 A * 7/1988 McGourty et al.
4,832,385 A * 5/1989 Llort ..... 292/144
4,833,465 A * 5/1989 Abend et al. ..... 292/144 X
4,995,248 A * 2/1991 Liu ..... 70/283 X
5,061,923 A 10/1991 Miller et al. ..... 340/825.31
5,265,452 A * 11/1993 Dawson et al. ..... 70/277 X
5,307,656 A * 5/1994 Gartner et al. ..... 70/303 A X
5,487,290 A 1/1996 Miller et al. ..... 70/303 A
5,595,838 A * 1/1997 Clark et al. ..... 70/333 R X
5,647,235 A * 7/1997 Clark et al.
5,653,135 A * 8/1997 Miller et al. ..... 70/303 A
5,715,716 A * 2/1998 Miller et al.
5,720,194 A * 2/1998 Miller et al. ..... 70/303 A
5,839,306 A * 11/1998 Nunuparov ..... 70/283
5,862,692 A 1/1999 Legault et al. ..... 70/278
5,881,589 A 3/1999 Clark et al. ..... 70/278
5,896,026 A * 4/1999 Higgins ..... 320/166
5,960,655 A * 10/1999 Miller et al. ..... 70/303 A
6,000,609 A 12/1999 Gokcebay et al. ..... 235/382
6,038,897 A * 3/2000 Dawson et al. ..... 70/333 R X

* cited by examiner

ELECTRONIC COMBINATION LOCK HAVING ANTI-TAMPERING FEATURES

This application is a continuation-in-part of application Ser. No. 09/985,975 filed Nov. 7, 2001 (now pending), which is a continuation of application Ser. No. 09/409,760 filed Sep. 30, 1999 (now U.S. Pat. No. 6,314,773), which is a continuation of application Ser. No. 08/985,901 filed Dec. 5, 1997 (now U.S. Pat. No. 5,960,655), which is a continuation of application Ser. No. 08/593,725 filed Jan. 29, 1996 (now U.S. Pat. No. 5,720,194), which is a division of application Ser. No. 08/371,319 filed Jan. 11, 1995 (now U.S. Pat. No. 5,487,290), which is a continuation of application Ser. No. 07/819,216 filed Jan. 13, 1992 (now abandoned).

FIELD OF THE INVENTION

The present invention generally relates to electronic combination locks and, more particularly, electronic combination locks requiring a small amount of electrical power to be placed in an unlockable condition and then requiring the user to manually retract the lock-bolt after being placed in the unlockable condition.

BACKGROUND OF THE INVENTION

One particular electronic combination lock is shown and described in U.S. Pat. No. 5,881,589 (the '589 patent), the disclosure of which is hereby fully incorporated by reference herein. Additional related locks are disclosed in U.S. Pat. Nos. 5,061,923 and 5,487,290, assigned to the assignee of the present invention and the disclosures of which are also fully incorporated by reference herein. The present invention improves upon these types of locks, however, the principles of the present invention are applicable to other electronic combination locks as well. The lock are described in the '589 patent and other similar locks essentially require the user to input a proper combination electronically. For example, this input can occur through rotating a combination dial or pressing the appropriate series of numbers on a keypad associated with the lock. The lock may be battery operated or powered by other sources. These locks may also have an electricity generating device, such as a stepper motor, for supplying a small amount of power for the combination input device as well as subsequent electrical functions. These subsequent electrical functions include the actuation of a small electrical actuator, such as a small stepper motor, to allow the lock to be placed into an unlockable condition. In the '589 patent, the stepper motor rotates a small gear and places the gear in an engageable position for meshing with another manually operable gear connected with the dial of the electronic combination lock. The gear connected to the stepper motor is further connected to one or more gears which ultimately connect with the lock-bolt. Other mechanical systems have also been used in place of a gear system, such as systems using levers, slides, etc., facilitating an operable connection between the manually rotatable drive gear or cam and the lock-bolt.

These general types of combination locks are used in high security applications and are in constant need of improvement to counteract the efforts of various unauthorized individuals from compromising the lock or, in other words, withdrawing the lock-bolt without entering the proper combination. One potential problem involves the rotation of the gear connected with the motor through some method that does not involve entering the proper combination into the lock. Once rotated into the engageable position through manual means or other means, the manually operable drive gear may be turned by the user to withdraw the lock-bolt. For reasons such as these, and to improve the overall security of electronic combination locks of this variety, it would be desirable to provide an electronic combination lock that provides further preventive measures against unauthorized entry through the lock.

SUMMARY OF THE INVENTION

The present invention therefore provides various improvements in the security of electronic combination locks. Generally, an electronic combination lock constructed in accordance with the invention includes an electronic combination input device, a lock-bolt mounted for movement between locked and unlocked positions, a rotatable first engagement element having disengaged and engageable positions, and a first electric actuator electrically connectable with the electronic combination input device and having a rotatable output for rotating the first engagement element to the engageable position thereof in response to a proper combination input into the electronic combination input device. A manually operated and rotatable second engagement element can be engaged with the first engagement element when the first electric actuator moves the first engagement element into its engageable position. A lock-bolt drive mechanism is operatively coupled between the lock-bolt and the first engagement element. Therefore, during normal operation, when the first engagement element is moved by the first electric actuator into its engageable position, the second engagement element may be rotated by the user to activate the lock-bolt drive mechanism and thereby move the lock-bolt to its unlocked position. In accordance with the improvements provided by the preferred embodiment of this invention, a second electric actuator having a movable output is also operatively coupled to the first engagement element and prevents the first engagement element from rotating until the proper combination is input by a user. Preferably, when the user inputs the proper combination, electric current is sent to both the first and second electric actuators such that these actuators are activated at least nearly simultaneously or in a manner allowing the second electric actuator to allow rotation of the first engagement element and then allow the first electric actuator to rotate the first engagement element into its engageable position.

The second electric actuator preferably prevents rotation of the first engagement element except upon entry of a proper combination. This second electric actuator is preferably an electric solenoid device having a movable member or portion which is operatively coupled to the first engagement element and may be electrically activated in at least one direction between the locked and unlocked positions. In one embodiment, a movable pin is normally spring-biased into a locked position within a hole or recess in the first engagement element and, under the effects of electric current, is driven to an unlocked position when the solenoid device is activated. The movable member may include a flat, resilient plate connected to a movable pin or portion of the solenoid device and disposed between the solenoid device and the first engagement element. Also, for retrofitting purposes, the first and second electric actuators are preferably mounted to a common support structure. This allows easy replacement of the electric motor, for example, used in a lock constructed according to the '589 patent, with the retrofittable assembly of the present invention.

While the use of a second electric actuator to prevent unauthorized rotation of the first engagement element is preferable, other means of preventing manual rotation of the first engagement element may be used as well. As one example, the first electric actuator could be substituted with a two-step actuator which must move both linearly and in a rotating manner to engage the second engagement element. Other manners of ensuring that the first engagement element cannot be moved into engagement with the second engagement element through manual effort without entering a proper combination may be utilized by those of ordinary skill as well while still retaining the inventive concepts expressed herein.

The present invention further contemplates a method of operating an electronic combination lock having a lock-bolt movable between locked and unlocked positions and a first engagement element movable into and out of an engaged position with respect to a second engagement element by a first electric actuator as generally discussed above. The method includes placing the lock-bolt into its locked position, preventing the first engagement element from being manually moved into engagement with the second engagement element to prevent movement of the lock-bolt to the unlocked position by the lock-bolt drive mechanism, and entering a proper combination into the electronic combination input device. Once the proper combination has been input by a user, a first pulse of electricity is sent to the electric actuator and it activates in response. A second pulse of electricity is sent to a second electric actuator or to another means to stop preventing the first engagement element from being manually moved into engagement with the second engagement element. This allows or causes the electric actuator to move the first engagement element into engagement with the second engagement element. In this manner, the lock-bolt may then be moved to the unlocked position using the lock-bolt drive mechanism and, for example, a manually rotatable dial on the outside of the lock. Other drives include knobs or levers, and in some cases, motorized drives for retracting the lock-bolt.

Various additional features, objectives and advantages of the invention will become more readily apparent to those of ordinary skill in the art upon review of the following detailed description of the preferred embodiment, taken in conjunction with the accompanying drawings.

DETAILED DESCRIPTION OF THE PREFERRED EMBODIMENT

Figure 1:
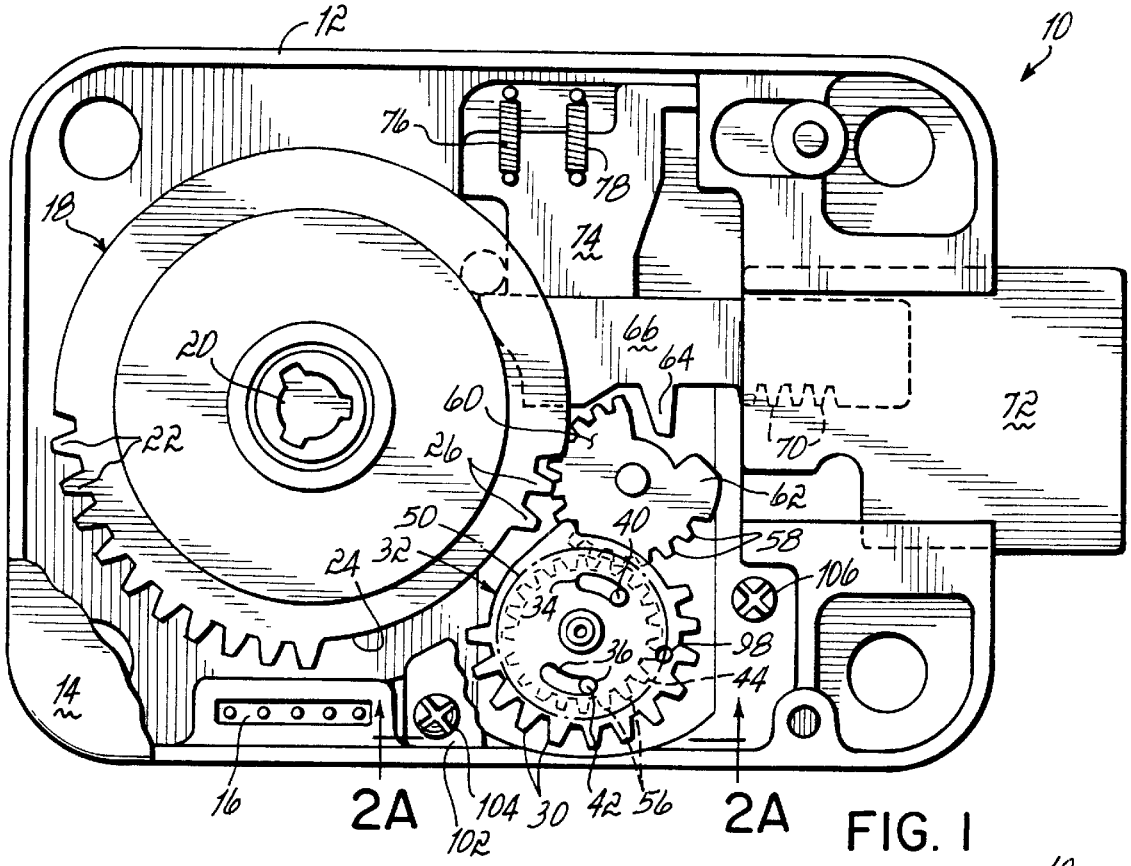
FIG. 1 is a partially fragmented elevational view showing the inside of an electronic combination lock constructed in accordance with the invention and shown in a locked position.
Figure 3:
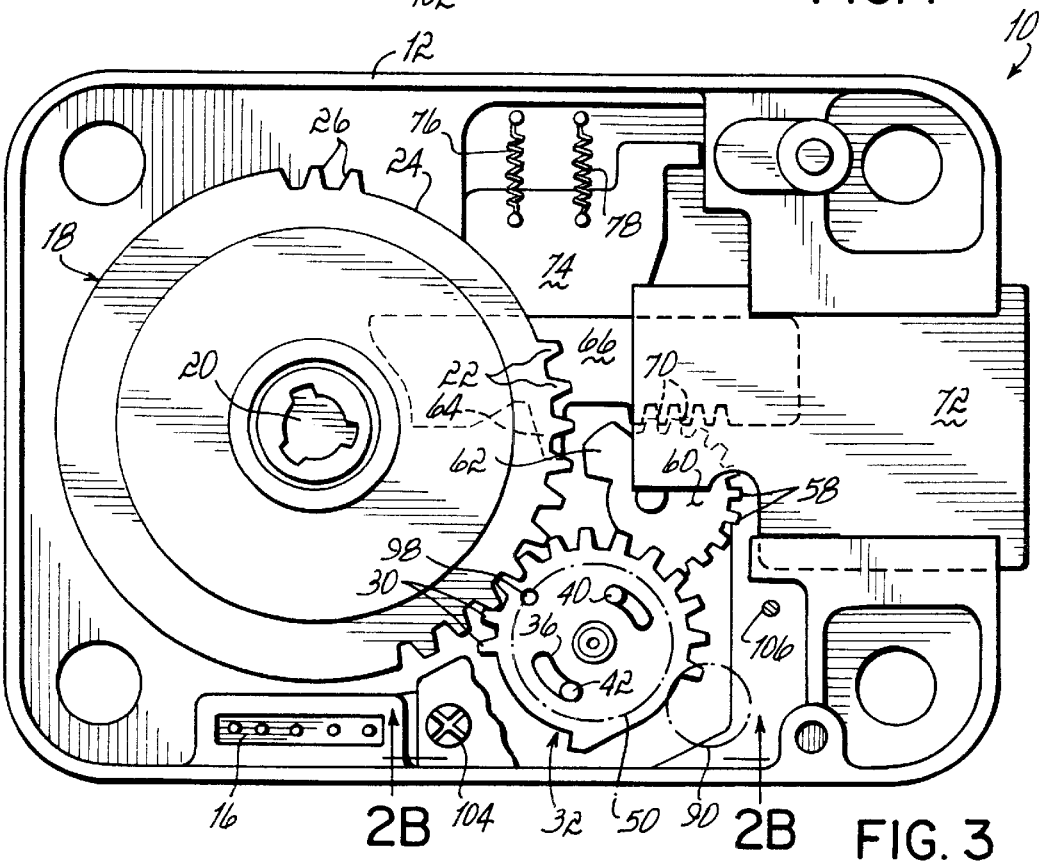
FIG. 3 is an elevational view similar to FIG. 1, but showing the lock in the unlocked position with the first engagement element or gear engaged with the second engagement element or gear.
Figure 1A:
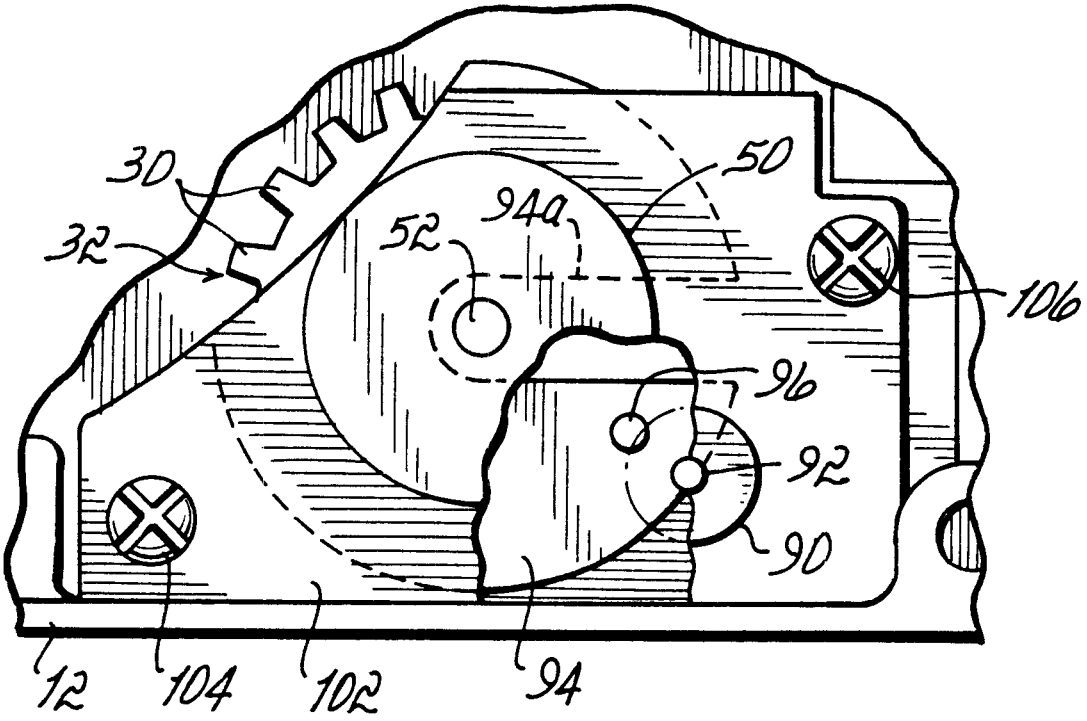
FIG. 1A is an enlarged, fragmented view showing the relative positions of the solenoid, electric motor, first engagement element or gear and locking pin of the preferred embodiment.

While the preferred embodiment will be specifically described in connection with improving upon the lock of the '589 patent, the principles are applicable to other locks as well. Referring first to FIGS. 1 and 3, and in order to generally review the operation of an electronic combination lock 10 constructed in accordance with the disclosure of the '589 patent, lock 10 includes a casing 12 in which the cover 14 has been substantially removed to show the inner components. An electrical connector 16 is provided for connecting the electrical drive and combination input components to the appropriate circuitry and control components (not shown). These components do not form part of the present invention and may be understood by those of ordinary skill by referring, for example, to the above-incorporated patents. A drive gear 18 is coupled to a shaft 20 which, in turn, is coupled to an outer dial (not shown) operable by a user.

Drive gear 18 includes a first plurality of teeth 22, a recessed, toothless space 24 and a second plurality of teeth 26 on its outer periphery. Teeth 22 and teeth 26 are adapted to engage teeth 30 of a gear 32 during operation of the lock. Gear 32 includes a pair of slots 34, 36 which respectively receive a pair of pins 40, 42 affixed to an idler gear 44. A stepper motor 50 includes a rotatable output 52 connected to rotate gear 32. Respective teeth 56 of idler gear 44 mate with teeth 58 of a gear 60 mounted for rotation within casing 12. Gear 60 includes an enlarged tooth 62 adapted to engage another enlarged tooth 64 extending from a rack 66. Rack 66 further includes a series of teeth 70, the purpose of which will be described below. Rack 66 is rigidly affixed to an extendable and retractable lock-bolt 72, which is shown in the locked or extended position in FIG. 1 and in the unlocked or retracted position in FIG. 3. A slide 74 normally blocks retraction of lock-bolt 72 and is biased in the upward position shown in FIG. 1 by springs 76, 78.

Under normal operation, and as more fully discussed in the '589 patent incorporated above, when a proper combination is input to a combination input device 80 (FIG. 2B) such as with a dial or keypad, gear 32 rotates approximately 36° so as to allow engagement of teeth 30 with teeth 22. Upon subsequent manual rotation of drive gear 18 by a user rotating an outer dial (not shown), teeth 22 engage teeth 30 to rotate gear 32 and, once pins 40, 42 are engaged with the opposite ends of slots 34, 36, also rotate idler gear 44. Idler gear 44 therefore rotates gear 60 in a counterclockwise direction to engage enlarged tooth 62 with enlarged tooth 64 and begin retracting lock-bolt 72. With further rotation of drive gear 18, as well as intermediate gears 32, 44, teeth 58 of gear 60 mesh with teeth 70 of rack 66 and complete the retraction of lock-bolt 72. As this is occurring, slide 74 is forced downwardly by a camming action (not shown), further described in the '589 patent, such that lock-bolt 72 is no longer blocked from retraction by slide 74.

Figure 2A:
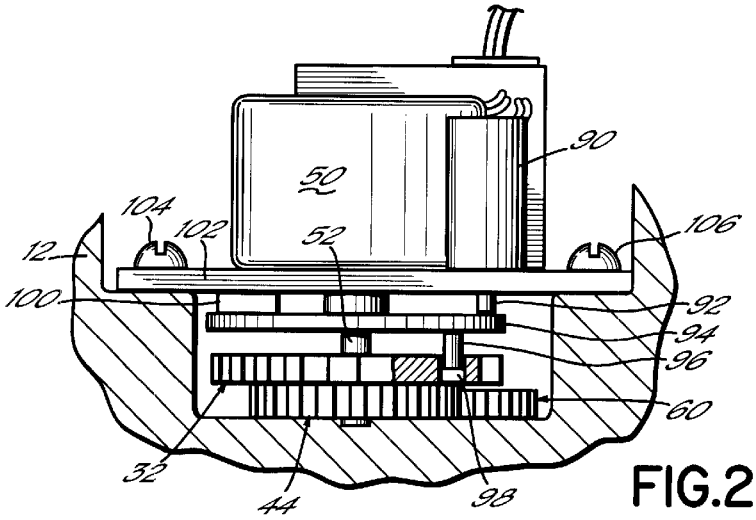
FIG. 2A is a cross sectional view taken generally along line 2A—2A of FIG. 1.
Figure 2B:
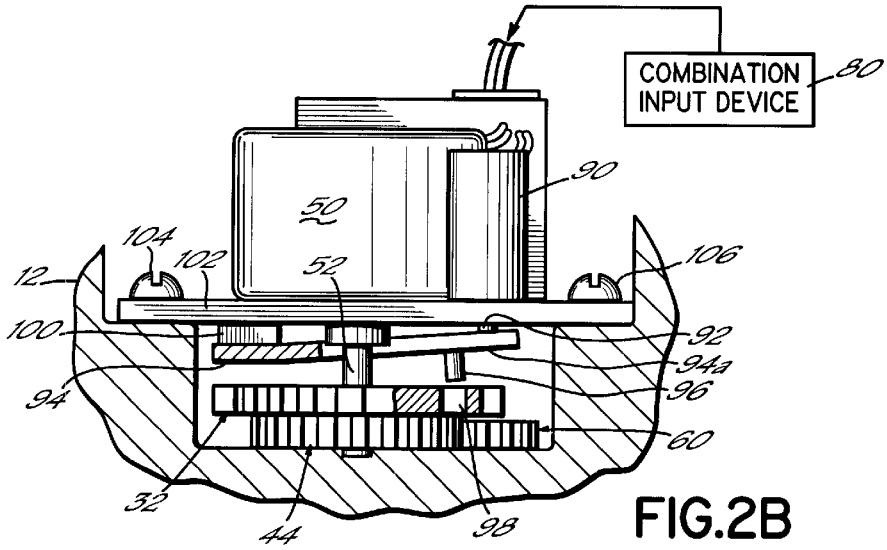
FIG. 2B is a cross sectional view taken generally along line 2B—2B of FIG. 3 and showing the second electric actuator or solenoid of the preferred embodiment in an unlocked position.
Figure 2C:
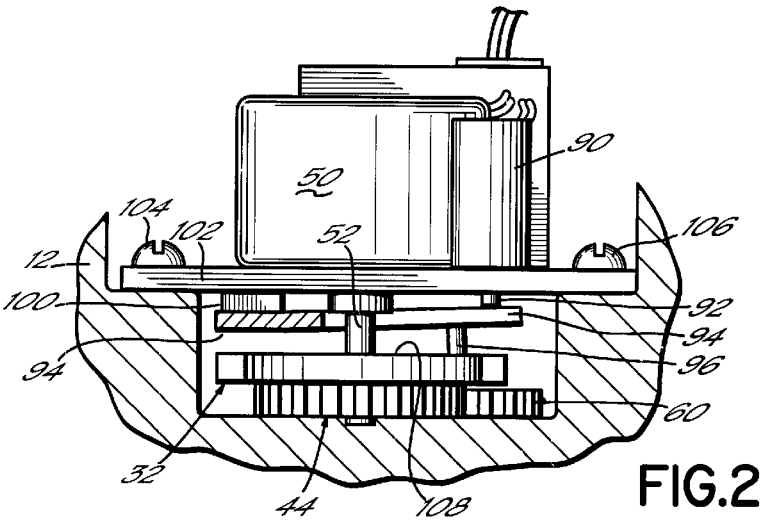
FIG. 2C is a cross sectional view similar to FIG. 2B, but showing the first engagement element or gear rotated to the engaged position.

As shown best in FIGS. 1A and 2A–2C, the preferred embodiment of the present invention adds an electric solenoid 90 having a linearly movable pin 92 retained for movement in a small electromagnetic coil (not shown) and normally retained in an extended position as shown in FIG. 2A. Pin 92 is affixed to a resilient, cantilevered plate 94 having a slot 94*a* allowing movement thereof around rotatable output 52 of stepper motor 50. A second pin 96 is affixed to the opposite side of plate 94 and is normally received in a hole or recess 98 in gear 32. This normally prevents any rotation of gear 32, such as by unauthorized methods. Plate 94 is affixed to a spacer 100 and this spacer 100 is further affixed to a support plate 102. Support plate 102 serves additionally as a mounting plate for stepper motor 50 and solenoid 90 and is fastened to casing 12 by screw fasteners 104, 106 allowing the entire unit to be incorporated as a retrofit unit to improve the security of an existing lock. From a review of FIGS. 2A–2C, it will be appreciated that when solenoid 90 is activated to retract pin 92 against the bias of resilient plate 94, pin 96 is withdrawn from hole or recess 98. This simultaneously allows stepper motor 50 to rotate gear 32 in accordance with the lock operation as discussed above. Preferably, the same electric current supply that operates stepper motor 50 is used to operate solenoid 90. In accordance with the above-incorporated patents, this need only be a short pulse of electricity to each of these low power actuators 50, 90. As the pulse of electricity that operates solenoid 90 is of short duration, pin 92, plate 94 and pin 96 quickly extend again as shown in FIG. 2C to ride along surface 108 of gear 32. At this time, gear 32 has already partially rotated such that hole or recess 98 is no longer in registration with pin 96. After lock-bolt 72 has been retracted and then extended again in accordance with the lock operation discussed above and further discussed in the incorporated '589 patent, gear 32 will again rotate such that hole or recess 98 receives the spring-biased pin 96 and, at this time, gear 32 is again locked in place and cannot be manually moved into its engageable position with drive gear 18.

Many other manners of preventing movement of the first engagement element or gear prior to the input of a proper combination may be used other than those specifically discussed above. For example, the first engagement element, or gear in the preferred embodiment, may be locked in place by many other different mechanical, electrical or magnetic elements. An electromagnetic device, for example, may be used to attract and/or repel a mechanical element which is not directly connected to the electromagnetic device but directly or indirectly engages and locks the first engagement element in place until the input of a proper combination. The first and second electric actuators, while described respectively as a stepper motor and a solenoid device in the preferred embodiment, may also be any other type of electric actuator performing the intended functions.

As one additional specific example, the solenoid device may comprise a copper coil disposed adjacent a permanent magnet, for example, within device 90, with respective conducting wires of the coil directed past the permanent magnetic and connected directly to the cantilevered, resilient plate 94. Plate 94 may also carry electric current to the wires, for example, in a manner similar to a circuit board. When the coil is energized, it is repelled away from the permanent magnet thereby pulling the cantilevered plate upwardly, as shown in FIG. 2C, due to a repelling force between the coil and the permanent magnet. When the current is removed, the coil moves in the opposite direction as the resilient cantilevered plate 94 biases back toward gear 32 and pulls the coil back toward the magnet. As stated herein, this comprises just one additional example of a system for preventing rotation of gear 32 or another first engagement element by manual or other unauthorized efforts, until a proper combination has been input by the user.

Figure 4:
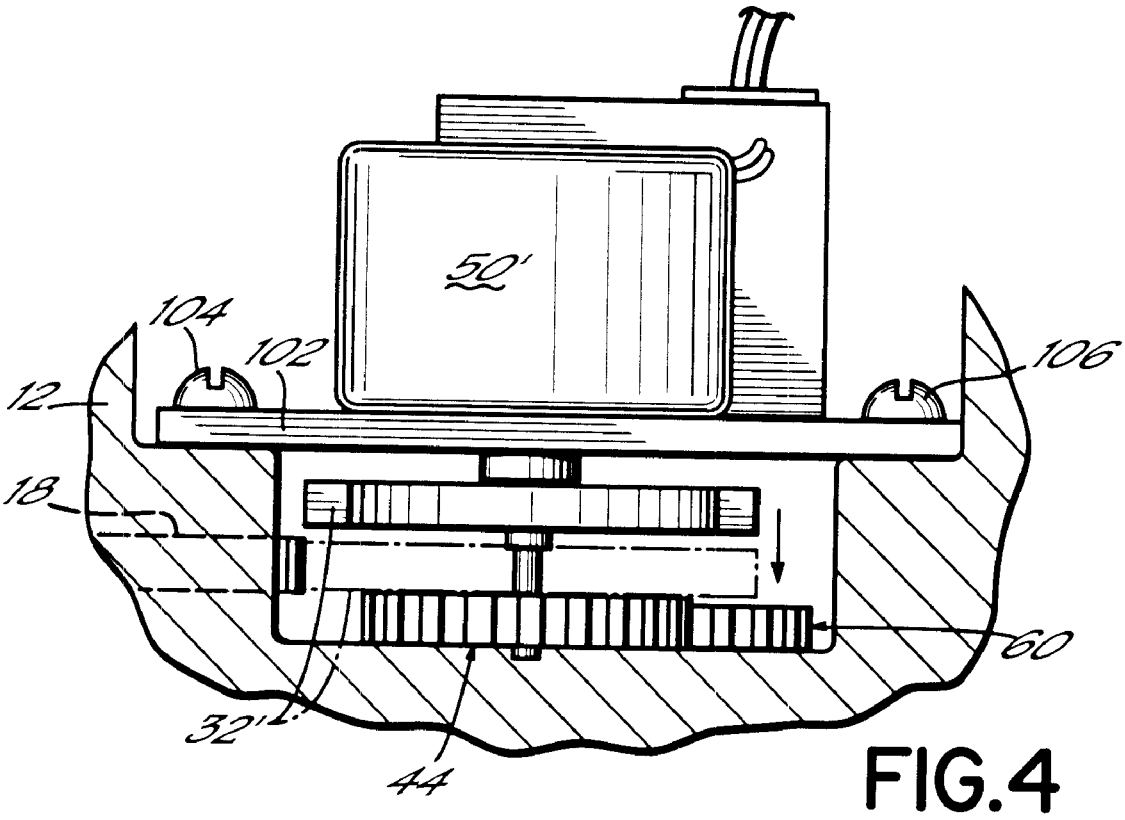
FIG. 4 is a schematic view of an alternative embodiment of a portion of an electronic combination lock constructed in accordance with the invention.

With reference to FIG. 4, like reference numerals refer to like features as in FIGS. 1 and 2A–C. In the embodiment of FIG. 4, stepper motor 50 has been substituted with a two-step actuator 50'. Upon input of a proper combination into a combination input device 80 (FIG. 2B), electric actuator 50' is operative to move gear 32' linearly and rotatably from a position in which gear 32' is disengaged from drive gear 18 to a position (shown in phantom) in which gear 32' is engageable with drive gear 18.

While the present invention has been illustrated by a description of one preferred embodiment and while this embodiment has been described in considerable detail, it is not the intention of the Applicants to restrict or in any way limit the scope of the appended claims to such detail. Additional advantages, modifications and adaptations of this invention will become apparent to those skilled in the art upon reviewing this disclosure. The invention in its broader aspects is therefore not limited to the specific details, representative apparatus and method as shown and described. The invention itself should only be defined by the appended claims, wherein.

We claim:

1. An electronic combination lock comprising:

an electronic combination input device;

a lock-bolt mounted for movement between locked and unlocked positions;

a rotatable first engagement element having disengaged and engageable positions;

a first electric actuator electrically coupled with the electronic combination input device and having a rotatable output for rotating the first engagement element to the engageable position thereof in response to a proper combination input into the electronic combination input device;

a rotatable second engagement element which can be engaged with said first engagement element in said engageable position thereof;

a lock-bolt drive mechanism operatively coupled between the lock-bolt and the first engagement element; and a second electric actuator operatively coupled to the first engagement element to prevent the first engagement element from rotating until the proper combination is input.

2. The lock of claim 1, wherein the first engagement element includes an outer periphery with a first set of gear teeth and the second engagement includes an outer periphery with a second set of gear teeth, said first and second sets of gear teeth being engageable to allow manual rotation of the second engagement element upon actuation of the first and second electric actuators.

3. The lock of claim 1, wherein the second electric actuator further comprises a solenoid device with a movable member which is operatively coupled to the first engagement element and may be electrically activated in at least one direction between locked and unlocked positions.

4. The lock of claim 3, wherein said movable member is in the locked position when the solenoid device is inactivated and is in the unlocked position when the solenoid device is activated.

5. The lock of claim 3, wherein said movable member includes a portion that directly engages the first engagement element.

6. The lock of claim 5, wherein said movable member further comprises a flat, resilient plate disposed between the second electric actuator and the first engagement element.

7. The lock of claim 1, wherein said first and second electric actuators are mounted to a common support structure which serves as a retrofit unit for said lock.

8. An electronic combination lock comprising:

an electronic combination input device;

a lock-bolt mounted for movement between locked and unlocked positions;

a rotatable first engagement element having disengaged and engageable positions, a first electric actuator electrically coupled with the electronic combination input device and operatively coupled with the first engagement member for moving the first engagement element to the engageable position thereof in response to a proper combination input to the electronic combination input device;

a manually operated and rotatable second engagement element which can be engaged with said first engagement element in said engageable position thereof;

a lock-bolt drive mechanism operatively coupled between the lock-bolt and the first engagement element and operable to place the lock-bolt into the unlocked position upon rotation of the second engagement element after the first and second engageable elements are engaged; and means for preventing manual movement of said first engagement element into engagement with said second engagement element prior to input of the proper combination into said electronic combination input device;

wherein the first engagement element includes an outer periphery with a first set of gear teeth and the second engagement element includes an outer periphery with a second set of gear teeth, said first and second sets of gear teeth being engageable to allow manual rotation of the first engagement element upon actuation of the first electric actuator and manual rotation of the second engagement element.

9. The lock of claim 8, wherein the means for preventing engagement of the first and second engagement elements further comprises a solenoid device with a movable member which is operatively coupled to the first engagement element and may be electrically activated in at least one direction between locked and unlocked positions.

10. The lock of claim 9, wherein said movable member is in the locked position when the solenoid device is inactivated and is in the unlocked position when the solenoid device is activated.

11. A method of operating an electronic combination lock having a lock-bolt movable between locked and unlocked positions and a first engagement element movable into and out of an engaged position with respect to a second engagement element by a first electric actuator, said first electric actuator being coupled with an electronic combination input device and said first and second engagement elements being operatively coupled with a lock-bolt drive mechanism, the method comprising:

placing the lock-bolt into the locked position;

preventing the first engagement element from being manually moved into engagement with the second engagement element to prevent movement of the lock-bolt to the unlocked position by the lock-bolt drive mechanism;

entering a proper combination into the electronic combination input device;

sending a first pulse of electricity to activate the first electric actuator in response to entering the proper combination;

sending a second pulse of electricity to stop preventing the first engagement element from being manually moved into engagement with the second engagement element;

moving the first engagement element into engagement with the second engagement element with the activated first electric actuator; and moving the lock-bolt to the unlocked position with the lock-bolt drive mechanism when the first and second engagement elements are engaged with each other;

wherein the preventing step further comprises preventing movement of the first engagement element using a second electric actuator which receives the second pulse of electricity.

12. The method of claim 11, wherein the activating step further comprises activating the second electric actuator in response to entering the proper combination such that the second electric actuator allows the first electric actuator to move the first engagement element.

13. The method of claim 12, further comprising:

generating electricity using a manually operable input member of said lock;

storing the electricity; and using the electricity to send the first and second pulses of electricity and activate the first and second electric actuators in response to entering the proper combination.

14. The method of claim 11 further comprising:

generating electricity using a manually operable input member of said lock;

storing the electricity;

using the electricity to activate the first electric actuator in response to entering the proper combination and thereby move the first engagement element into engagement with the second engagement element.

15. An electronic combination lock comprising:

an electronic combination input device;

a lock-bolt mounted for movement between locked and unlocked positions;

a movable first engagement element having disengaged and engageable positions;

a rotatable second engagement element which can be engaged with the first engagement element in the engageable position thereof;

a lock-bolt drive mechanism operatively coupled between the lock-bolt and the first engagement element; and a two-step electric actuator operative to move the first engagement member linearly and in a rotating manner to the engageable position thereof in response to a proper combination input into the electronic combination input device.

16. The lock of claim 15, wherein the first engagement element includes an outer periphery with a first set of gear teeth and the second engagement element includes an outer periphery with a second set of gear teeth, said first and second sets of gear teeth being engageable to allow manual rotation of the first engagement element upon actuation of the two-step electric actuator and manual rotation of the second engagement element.

* * * * *